US005120246A

United States Patent [19]

Knox

[11] Patent Number: 5,120,246

[45] Date of Patent: Jun. 9, 1992

[54] SOLDERLESS ELECTRICAL CONNECTOR

[75] Inventor: George J. Knox, Austin, Tex.

[73] Assignee: Minnesota Mining and Manufacturing Company, St. Paul, Minn.

[21] Appl. No.: 762,970

[22] Filed: Sep. 23, 1991

Related U.S. Application Data

[63] Continuation-in-part of Ser. No. 642,534, Jan. 17, 1991, Pat. No. 5,067,910.

[51] Int. Cl.[5] ..... H01R 4/24

[52] U.S. Cl. ..... 439/402; 439/417; 439/680

[58] Field of Search ..... 439/366, 367, 372, 402, 439/417, 418, 592, 680

[56] References Cited

U.S. PATENT DOCUMENTS

| | | | |
|---|---|---|---|
| 3,573,713 | 4/1971 | Enright et al. | 439/402 |
| 3,890,029 | 6/1975 | Izraeli | 439/402 |
| 3,899,236 | 8/1975 | Santos | 439/402 |
| 4,326,767 | 4/1982 | Silbernagel et al. | 439/402 |
| 4,764,129 | 8/1988 | Jones et al. | 439/680 |
| 4,813,883 | 3/1989 | Staley | 439/402 |
| 4,820,191 | 4/1989 | Lacroix | 439/402 |
| 4,891,018 | 1/1990 | Afflerbaugh et al. | 439/402 |

*Primary Examiner*—Paula A. Bradley
*Attorney, Agent, or Firm*—Gary L. Griswold; Walter N. Kirn; John C. Barnes

[57] ABSTRACT

A wire connector having a base and cap, and the base and cap are provided with interfitting tapered keys and keyways to retain the cap in place on the base member and help maintain the cap on the base by the interfit between the walls of keys with the converging walls of the keyways.

12 Claims, 3 Drawing Sheets

SOLDERLESS ELECTRICAL CONNECTOR

RELATED APPLICATIONS

This application is a continuation-in-part of application Ser. No. 07/642,534 filed Jan. 17, 1991, now U.S. Pat. No. 5,067,910.

BACKGROUND OF THE INVENTION

1. Field of the Invention

The present invention relates to an improvement in solderless electrical connectors having a base and cover which close on the wires to be joined and in one aspect to the improved mechanical locking features for the cap to hold the same to the base member for shipping and handling prior to the making of a splice.

2. Description of the Prior Art

The present invention is directed at an improvement of the solderless connector described in U.S. Pat. No. 3,012,219, and as shown in Des. 191,399. The present invention also relates to U.S. Pat. No. 4,891,018, describing a new connector formed of a less rigid material, like a polyolefin, than the previously used polycarbonate material. The more flexible material provides many advantages, including the fact that it is more supple and elastic than polycarbonate. The good characteristics have also made it important to modify the structure of the basic parts of the connector to obtain the same performance. One change is to modify the cap and base design to secure the caps to the base and restrict the same from becoming dislodged and separated prior to the actual taking of the connectors out of the box or dispenser for use in splicing the wires.

U.S. Pat. No. 4,891,018 provided a new design for maintaining the cap and base assembled after making the insulation displacement wire connection. Parent application Ser. No. 642,534 is directed to an invention showing one structure for retaining a cap in place utilizing a mechanical latching design wherein a wedge shaped member resists the upward movement of the cap when assembled on the base prior to closing the cover on the base.

The present invention provides a further design for the cap and base to hold the members together prior to use, and one which makes the same easy to assemble and it has a self actuated retention system or lock generating feature if forces are applied tending to separate the caps from the base members during shipping and handling prior to the use of the connector ultimately to connect a plurality of wires.

The following patents do illustrate the use of caps and base members wherein the cap is formed with a rib which fits into a detent extending generally perpendicular to the direction of movement of the cap in relationship to the base when assembling the cap and base to complete a connection to a plurality of wires. Such patents include U.S. Pat. Nos. 3,718,888; 3,804,971; 4,326,767; 4,444,448 and 4,496,206. These interfitting ridges and grooves do not work satisfactorily on circular telescoping members.

A pertinent patent which shows the use of a vertical rib on the cap and a vertical groove on the base is U.S. Pat. No. 4,444,449. This patent discloses a wire connector where there is interference fit between the telescopically inserted cap and the base up to the abutment 15 thereof. Further, there are grooves 17 in the side walls of the base 1 and complementary protrusions 19 on the upper cap 11 to provide proper orientation of the housing parts. The upper cap also supports metal contact element to cut through the insulation of the wires. In this device the parts, cap and base are formed of polycarbonate and they telescope together in the tapered opening 13 in the top of the base. There is no other teaching of the protrusions and grooves having an interference fit to hold the parts in the preassembled relationship. With the use of softer materials there needs to be adequate support to avoid the dislodging of the caps from the base.

The present invention affords an improvement in the cap retention means to restrict the cap from becoming dislodged from the base prior to assembly and which aids in maintaining the parts fixed after the telescopic insertion of the cap in the base.

SUMMARY OF THE INVENTION

The present invention provides an improved wire connector for connecting a plurality of wires and comprises a base member having a plurality of elongate wire-receiving channels leading through a throat portion into a cavity in the base member. The base member has at least one groove extending transversely across the wire-receiving channels in the cavity, which is generally perpendicular to the channels. The base member has wall members defining the cavity, enclosing the wire-receiving channels, which wall members have inner and outer surfaces, with the walls of the cavity diverging from an opening into the cavity toward the bottom surface.

A cap, shaped to fit in the cavity of the base member, includes an end wall and depending side walls diverging from the end wall. The side walls have two legs extending beyond the free edges of the side walls at peripherally spaced locations and a wire connecting member is positioned between the legs and against the interior surface of the end wall. The legs diverge from the free edges of the side walls and are shaped to fit within the cavity when the cap is placed on the base member. The dimension of the free edges of the depending side walls of said cap are slightly greater than the inside dimension of the opening in the base member and when the cap is telescopically inserted into the base member the opening at the top of the cavity expands to permit entry of the cap and helps to hold the members in the wire splicing assembled position.

The wall members of the base or cap are formed with keys or ribs extending generally radially therefrom. The keys extend the height of the wall members and have a truncated V-shape or a trapezoid in cross-section. The walls of the other body portion, the base or cap, are formed with cooperating generally v-shaped keyways or grooves, with a truncated or flat bottom wall, to define a keyway which makes an interference fit with the keys or ribs formed on the other portion to retain the members assembled with the cap in position and to restrict tipping movement of the cap with respect to the base prior to assembly.

It is preferred that the keys or ribs be formed in the base and that the keyways or grooves be formed in the side wall members of the cap and in the legs which extend beyond and outward from the free edges of the side wall members.

Then the base and cap are formed of flexible polyolefin, the base will stretch slightly for receiving the cap in a locking position. The cap is provided with a rib about its periphery which will engage the inside walls of the base to restrict its displacement under the stress resulting from temperature change, lightning strikes and other environmental causes.

BRIEF DESCRIPTION OF THE DRAWING

The present invention will be further described with reference to the accompanying drawing, wherein.

DESCRIPTION OF THE PREFERRED EMBODIMENT

Figure 1:
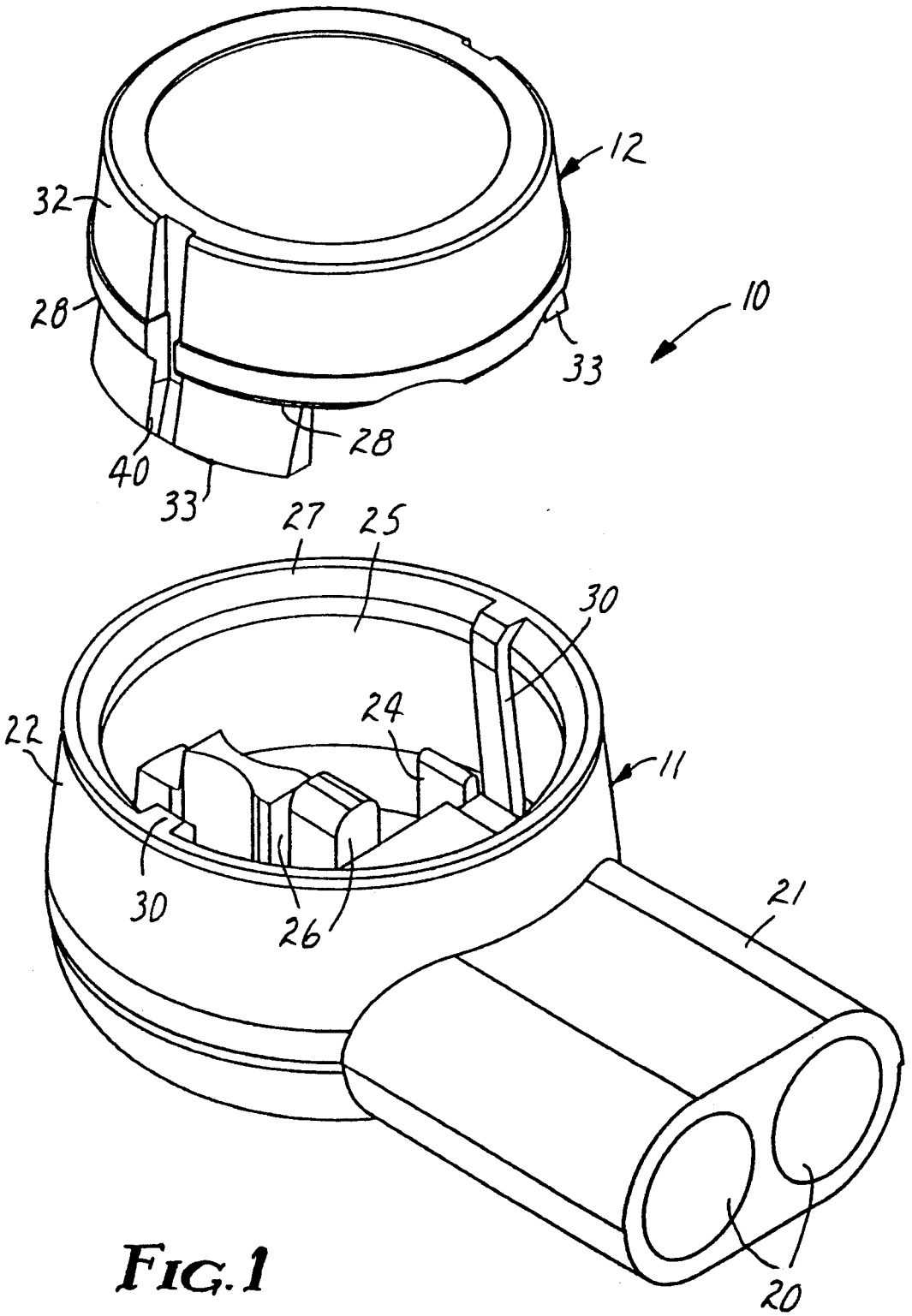
FIG. 1 is a perspective view of a connector according to the present invention, showing the base and cap in exploded view.
Figure 2:
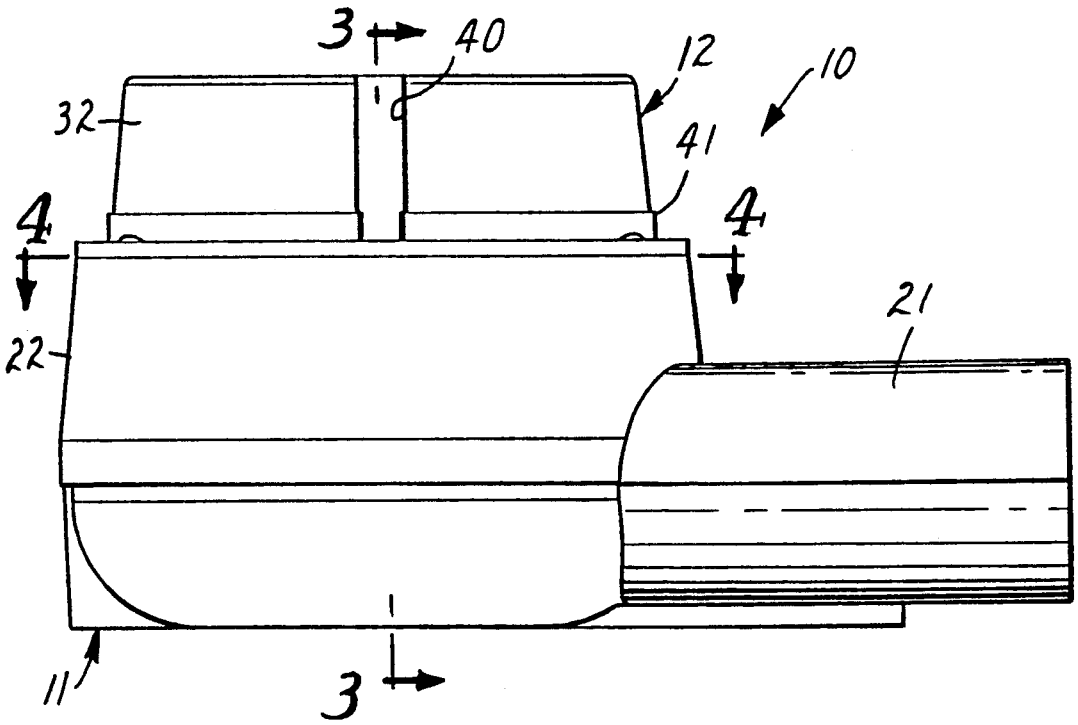
FIG. 2 is a side elevational view of the connector of FIG. 1 with the cap on the base.

The present invention will be described with reference to the drawing wherein like reference numerals refer to like parts throughout the several views.

Figure 3:
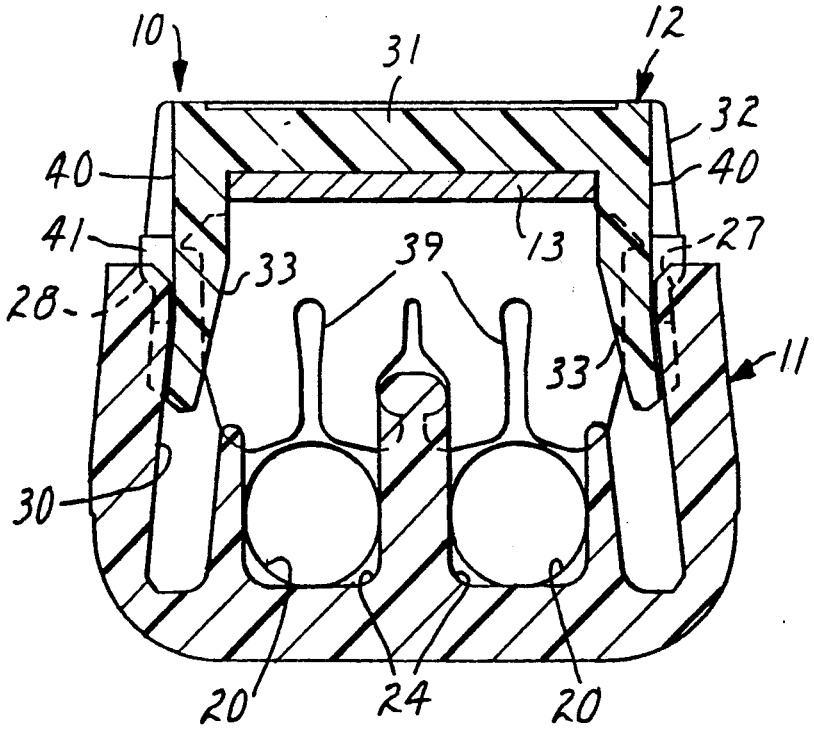
FIG. 3 is a vertical sectional view taken along line 3—3 of FIG. 2.

The connector 10 of FIG. 1 comprises an insulating base 11 and an insulating cap 12. A generally U-shaped, conductive connecting member 13 (see FIG. 3) is supported by the cap 12 and affords good electrical insulation displacement contact with a pair of wires.

The base 11 comprises multiple longitudinal side-by-side tubular wire-receiving passages 20, extending through a throat portion 21. The passages 20 begin at an end of the throat portion 21 of the base 11 and extend into a body portion 22 where they provide wire supporting channels 24, see FIGS. 3 and 4. The interior of the body portion 22 is formed with a cavity 25 communicating with the channels 24 and the base of this cavity 25 is deeply grooved transverse to the channels 24 to provide transverse slotted areas or grooves 26 to receive the deeply grooved parallel plates of the connecting member 13. The cavity 25 has a generally truncated conical shape and extends from an opening in the upper extended body portion 22 to the wire supporting channels 24 and is defined by interior wall surfaces which are disposed at an angle of about 6° to the axis of the conical cavity.

The wall members defining the cavity 25 are formed with a support surface 27 to support the cap 12 with the depending legs 33 thereof extending into the cavity 25 and engaged with the walls thereof to locate the cap 12 on the base 11 in an open position. The legs are formed to diverge from the free edges of the cap side walls. As such the legs are forced toward each other to place them in the cavity during assembly of the corrector. The legs then extend parallel to the inner surfaces of the wall members of the base. A surface 27 and the bottom surface 28 of the cap 12 serve to place an opening force on the opening to the cavity to expand the opening and accept the larger cap when the base member 11 and the cap 12 are assembled to splice the plurality of wires inserted therein.

The wall surfaces of the base 11 are formed with a pair of ribs or keys 30, which extend radially from the inner wall surfaces and an equal distance from the wall surfaces along their length, and, as illustrated, are positioned near the ends of the transverse grooves 26. The keys 30 extend the height of the wall surfaces and have converging wall surfaces with a flat connecting outer edge to define a key which is a truncated V-shape or trapezoid in cross-section to wedge in the keyway. The base 11 is preferably molded of a flexible polymeric material which is preferably translucent, solvent resistant and hydrophobic and is resilient, i.e. it has good tensile strength and sufficient elasticity to afford at least 10 to 20% elongation. A preferred material with these properties is a polyolefin, for example polypropylene which is less expensive then polycarbonate.

The cap 12 is the support for the connecting member 13 and can also be formed of a polyolefin such as polypropylene. The cap 12 comprises an end or top wall 31 and generally conical, peripheral side walls 32. Extending from the free edges of the side walls 32, at opposed sides thereof, are a pair of legs 33. The legs 33 diverge from the free edges of the side walls 32 and are disposed to be generally parallel with the inner surfaces of the wall portions of the base member 11. The legs 33 as illustrated are disposed adjacent the ends of the deeply grooved plates of the U-shaped connecting member 13. When the cap is placed on the base member in the open position the legs 33 are positioned within the cavity 25.

The cap 12, of the connector illustrated, includes a groove forming a keyway 40 which cooperates with the rib or key 30 extending outward from and upward along the inner wall surface of the base member 11 defining the cavity 25. The cap 12 also has an outer raised circumferential or peripheral ring or rib 41 above a beveled surface on the free edges of the side walls 32. The rib 41, when placed in the cavity 25 as the cap is moved to the wire splicing position, will engage the side walls of the base and restrict the displacement of the cap when the junction is under stress from temperature changes, lightning strikes and other environmental causes.

The connecting member 13 is formed of electrically conductive ductile metal. The metal is preferably an alloy, and an alloy which would reach 10% elongation before fracture and a yield stress between 60 and 80 thousand psi (415 and 550 MPa) is preferred. An example is a copper alloy, about 0.0159 inch (0.4 mm) thick, such as 260 cartridge brass with a hardness of $\frac{3}{4}$ or HO/3. The connecting member 13 is supported within the cap 12 and is retained therein by barbs extending outwardly of opposite ends thereof to penetrate the material of the legs, see FIG. 3. The connecting member 13 is a generally U-shaped member having two thin parallel plates which are deeply grooved to form U slots 39 for receiving and displacing the insulation on the wires to be joined and make a resilient, spring compression reserve, electrical connection to the conductor of the wires. The plates of the connecting member 13 are parallel and spaced about 0.050 inch (1.27 mm) apart. The wire receiving slots 39 are spaced 0.126 inch (3.2 mm) apart in each plate. Disposed between the wire receiving slots 39 is a clearance slot which affords greater flexibility for the connecting member. The wire-receiving U-slots are originally 0.0115 inch (0.29 mm) in width between the parallel portions of the opposing surfaces defining the slots 39.

Figure 4:
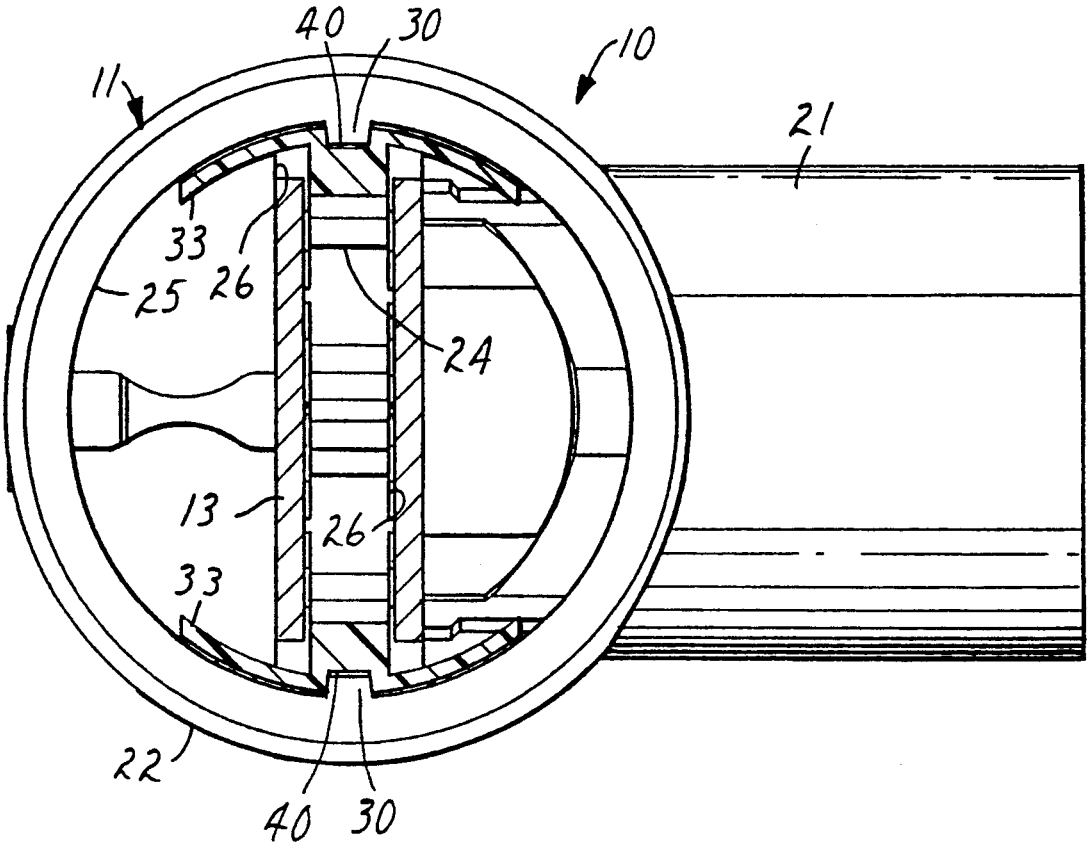
FIG. 4 is a longitudinal sectional view taken along line 4—4 of FIG. 2.
Figure 5:
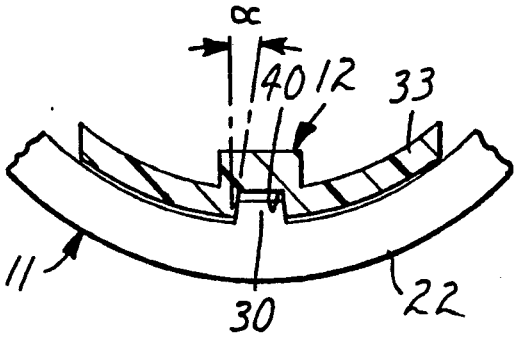
FIG. 5 is a schematic sectional view illustrating the wedging and locking surfaces between the keys of the base member and the keyways of the cap.

As illustrated in greater detail in FIGS. 4 and 5, the keys 30 and keyways 40 interfit along their length to restrict displacement of the cap from the base member and to restrict tipping of the cap before and during the closing of the connector. Further, the plates of the connecting member 13 are to be positioned parallel to the transverse grooves 26, and as illustrated the key or keys and associated keyway properly locate the cap on the base to assure such location.

The fit between each key and keyway is critical to the performance of the locking design of the present invention. Each cap leg 33 has a trapezoid-shaped tapered keyway 40 molded in it such that the depth of the keyway is constant from the bottom of the rib 41 to the bottom of the leg. The base member 11 has the trapezoid shaped ribs or keys 30 molded on the inner surface of the wall members forming the cavity 25 and the keys 30 are located to align with the keyways. The keys 30 project radially and have a constant height measured from the wall surface along their length. The keyway has a constant cross-section from the bottom of the rib 41 to the free end of the leg. The key 30 and keyway 40 are dimensioned so their converging or tapered sides meet with theoretical surface-to-surface contact, see FIG. 4 and FIG. 5. The converging walls and the angle of convergence create a force between the walls, which force is created by the spring force inherent in the legs 33, (created from the deflection of the legs 33) which force is sufficient to hold the keys and keyways together. When a force is exerted to lift the cap off the jacket, or is created by tilting the cap, the force against the key increases and the force between the tapered walls of the keys and keyways increases. This increased force results in increased frictional forces that resist the cap from lifting off or becoming dislodged.

The key 30 must not touch the bottom of the keyway 40, and the outer surface of the leg must not touch the inner wall surface of the wall members of the cavity. If these conditions are met, the force required to pull the cap out of the jacket will be increased by a predictable amount when compared with a construction without this ribbed and wedging configuration. The amount of resistance is established by the angle $\alpha$ of the taper. This characteristic of sliding V-grooves is known to engineering students, and is shown specifically on page 3–29 of Marks Standard Handbook for Mechanical Engineers, Ninth Edition, published in 1986, printed and bound by R. R. Donnelley & Sons Company for McGraw-Hill.

A smaller angle makes a larger force between the tapered walls. However, a smaller angle also causes a larger deviation in the location of the key within the keyway as the width of the key (or keyway) varies due to manufacturing tolerances. Since it is important that the bottom side of the keyway not touch the key, and the outer surface of the leg not touch the inner surface of the walls defining the cavity, the depth of the keyway must be controlled within known limits. The ideal compromise for this application is believed to be a taper or angle $\alpha$ of 6°. This increases extraction force required by a factor of 4.8, and a 0.001 inch (0.025 mm) change in key width results in a 0.005 inch (0.13 mm) change in depth of the key in the keyway. This is a significant product improvement with attainable manufacturing tolerances.

The present invention thus provides an improved connector for making good electrical connection and which uses less expensive materials in such a way as to provide redundant connection to a greater range of wire sizes. The illustrated embodiment provides the preferred construction, however it is contemplated that the key could be placed on the cap and leg with the keyway in the walls of the base member defining the cavity, but then the wall thickness of the base member would be so thin in the area of the keyway that it could be subject to cracking if the connector was used in a cold climate on a cold day.

Having thus described the present invention with reference to the preferred embodiment, it will be appreciated the further modifications may be made without departing from the spirit of the invention as defined in the appended claims.

I claim:

1. A wire connector for connecting multiple wires comprising;

a base member having a plurality of elongate side-by-side wire-receiving channels leading through a throat portion into a truncated conical cavity, said base member being formed with at least one groove extending transversely across the wire-receiving channels in the bottom of said cavity, said base member having wall members defining said cavity and enclosing said wire-receiving channels, which wall members have inner and outer surfaces, with the walls of the cavity diverging from an opening into the cavity toward the bottom thereof, a cap, shaped to fit in the cavity of the base member, including an end wall and depending side wall members diverging from the end wall, said side wall members having two legs extending beyond the free edges of said side wall members at peripherally spaced locations, and a wire connecting member positioned against the interior surface of said end wall of said cap, said legs of said cap diverging from the free edges of the side wall members and being shaped to fit within the cavity when the cap is placed on the base member, said wall members of one of the base member and cap being formed with at least one key extending generally radially therefrom and the other of said base member and cap being formed with a keyway, said key being of uniform cross-section along the length thereof which is that of a trapezoid and the keyway having a uniform cross-section to form a cooperating truncated V-shaped groove, such that the converging walls of the truncated groove contact the converging walls of the key and that a space exists between the bottom of the keyway and the end of the key.

2. A wire connector according to claim 1 wherein said base is formed of a translucent, solvent resistant, hydrophobic, resilient polymeric material.

3. A wire connector according to claim 2 wherein said polymeric material is a polyolefin.

4. A wire connector according to claim 3 wherein said polyolefin is polypropylene.

5. A wire connector for connecting multiple wires comprising;

a base member having a plurality of side-by-side elongate wire-receiving channels having extended surfaces to support a corresponding plurality of wires, said base member being formed with at least one groove extending transverse across said channel surfaces and generally perpendicular to said channels, wall members defining a cavity about said channel surfaces, said wall members having inner and outer surfaces, with the inner surface of the walls of the cavity diverging from an opening into said cavity toward said channel surfaces, and said wall members having peripherally spaced, truncated, generally V-shaped keys formed on the inner wall surface, a resilient conductive connecting member having at least one wide thin and deeply grooved plate adapted to fit within the transverse groove and with one of said grooves in said plate being aligned with each of said wire receiving channels, and a cap supporting said connecting member and shaped to fit in said cavity, said cap comprising an end wall and depending side walls which diverge from said end wall, said side walls having two legs extending beyond the free edges of said side walls at peripherally spaced locations, said connecting member being positioned between said legs and against the interior surface of said end wall, said legs and side walls of said cap having converging walls forming generally truncated V-shaped keyways along each leg and an adjacent portion of said side wall, said keyways being shaped to frictionally receive said keys with walls of the keys engaging the walls of the keyways and with the free truncated end of each key being spaced from the bottom wall of the keyway when said cap is placed on the base member, whereby each key is wedged against said converging walls of the keyway when a force tending to separate or tilt the cap, in relationship to the base member, is applied.

6. A wire connector according to claim 5 wherein said cap has an external peripheral rib on said side walls the peripheral dimensions of which exceed the inner peripheral dimensions of said peripheral edge of said opening of said base to restrict movement of said cap from closed position to open position.

7. A wire connector according to claim 8 wherein the converging walls of the keyway are disposed at 6°.

8. A wire connector according to claim 5 wherein said connecting member is U-shaped and has a pair of parallel plates each formed with wire receiving grooves for making connection with the wires to be joined.

9. A wire connector according to claim 8 wherein said metal is a ductile cartridge brass.

10. A wire connector according to claim 5 wherein said base is formed of a translucent, solvent resistant, hydrophobic, resilient polymeric material.

11. A wire connector according to claim 10 wherein said polymeric material is a polyolefin.

12. A wire connector according to claim 11 wherein said polyolefin is polypropylene.

* * * * *

UNITED STATES PATENT AND TRADEMARK OFFICE

CERTIFICATE OF CORRECTION

PATENT NO. : 5,120,246

DATED : June 9, 1992

INVENTOR(S) : George J. Knox

It is certified that error appears in the above-indentified patent and that said Letters Patent is hereby corrected as shown below:

Column 8, Line 9, "according to claim 8" should read -- according to claim 5--.

Signed and Sealed this

Tenth Day of January, 1995

Bruce Lehman

*Attest:*

BRUCE LEHMAN

*Attesting Officer*

*Commissioner of Patents and Trademarks*